United States Patent [19]

Platt, III, deceased

[11] 4,162,848

[45] Jul. 31, 1979

[54] APPARATUS FOR SELECTIVELY COPYING FROM TWO DIFFERENT DOCUMENTS

[75] Inventor: Albert H. Platt, III, deceased, late of Pittsford, N.Y., by Barbara B. Platt, administratrix

[73] Assignee: Eastman Kodak Company, Rochester, N.Y.

[21] Appl. No.: 923,873

[22] Filed: Jul. 12, 1978

[51] Int. Cl.[2] ..... G03G 15/00

[52] U.S. Cl. ..... 355/14; 355/46

[58] Field of Search ..... 355/14, 11, 3 R, 70, 355/46

[56] References Cited

U.S. PATENT DOCUMENTS

| | | | |
|---|---|---|---|
| 3,963,345 | 6/1976 | Stemmle et al. | 355/50 |
| 4,099,860 | 7/1978 | Connin | 355/14 |

*Primary Examiner*—R. L. Moses

*Attorney, Agent, or Firm*—G. Herman Childress

[57] ABSTRACT

A copier receives different documents on two platens, one of which preferably has a recirculating feeder associated with it for sequentially feeding a plurality of sheets from one document to the platen for copying each sheet in a known manner. The first platen is used to make most of the copies from the copier and is used to keep the machine running substantially continuously. The other platen can receive another original document including, for example, a document that is too large to be accommodated on the first platen or by the recirculating feeder, a document that will not feed reliably through the feeder (such as a document made by assembling copy onto a backing sheet) and a single sheet document. Thus the second platen can be used for making document masters that are then placed in the recirculating feeder on the first platen. A logic and control unit for the copier permits a document on the second platen to be copied while another job is being run at the first platen by temporarily interrupting the job being run at the first platen. After the required copies are made from the second platen, the logic and control unit restarts the job at the first platen.

9 Claims, 4 Drawing Figures

APPARATUS FOR SELECTIVELY COPYING FROM TWO DIFFERENT DOCUMENTS

CROSS REFERENCE TO RELATED APPLICATIONS

Reference is made to commonly assigned, copending U.S. patent application Ser. No. 647,683, filed Jan. 8, 1976, which is a continuation of application Ser. No. 523,610, filed on Nov. 13, 1974 now abandoned in the name of Mathew J. Russel and entitled RECIRCULATING SHEET FEEDER.

BACKGROUND OF THE INVENTION

1. Field of the Invention

This invention relates to reproduction apparatus in general and, more specifically, to copier/duplicators or the like. More particularly, the invention relates to the structure and control of a copier/duplicator so that two documents can be selectively copied.

2. Description of the Prior Art

Copier/duplicators typically comprise a single platen against which an original document is positioned for copying by exposing the document while on the platen and projecting an image of the document onto a photoconductor where the image is developed. The image then is transferred to a copy sheet and fused to the copy sheet. It is also known to provide document feeders which repetitively feed sheets of a multi-sheet document from a stack to the platen and then away from the platen so that the copier produces collated sets of copies. Examples of such document feeders are disclosed in the before mentioned copending U.S. patent application and in U.S. Pat. No. RE 27,976. Recirculating document feeders as disclosed in such copending application, provide significant improvements in the copying operation, especially in regard to the convenience to the user and the ability to make sets of copies without the need for a collator. However, when a user wishes to make copies of an especially large original document, or when the original document is prepared by pasting or otherwise assembling various portions of the document onto a backing sheet, the original may not feed reliably through the recirculating feeder. In some cases the recirculating feeder can be swung away from the platen to place the original document onto the platen, and then one or more copies of the original can be made. One or more "master" copies can be made in this manner and then placed in the recirculating feeder in order to produce collated sets of copies. However, it is somewhat inconvenient to move the recirculating feeder away from the platen, and it clearly would be advantageous to be able to make copies from oversize originals, paste-up documents or from other documents without having to manually interrupt the job being run on the recirculating feeder, swing the feeder away from the platen, make the required number of copies of the over-size or paste-up originals, and then restart the recirculating feeder operation. Also, when a long job is being run on a copier, it is desireable to be able to interrupt that job and run a short job or one with a higher priority with a minimum of inconvenience to the operator.

In some instances apparatus have been provided for making masters in a separate part of the copying apparatus and then feeding the master onto a cylinder or the like where a multitude of copies are made from the master in the usual manner. For example, see Canadian Pat. No. 946,460. This patent also discloses the idea of concurrently processing a master while copies are being made from a preceding master, and for delaying preparations of the second master until the printing time remaining in the printing run from the first master is about equal to the time required to make the second master. Other apparatus of this general type are disclosed in U.S. Pat. Nos. 3,612,682; 3,754,820; 3,827,803; 3,861,306 and 3,390,634. In addition, apparatus for making masters by means of an electrophotographic process are disclosed in a number of patents, including U.S. Pat. Nos. 3,448,970; 3,498,712 and 3,504,973

SUMMARY OF THE INVENTION

The present invention relates to apparatus for making document copies. The apparatus has a first platen for receiving a document to be copied and a second platen, spaced from the first platen, for receiving another document to be copied. Means are provided for making copies of documents received on said first and second platens. Control means responsive to the presence of a document on the second platen actuates the making means to make a copy of the document on the second platen prior to making a copy of the document on the first platen.

The invention, and its objects and advantages, will become more apparent in the detailed description of the preferred embodiments presented below.

BRIEF DESCRIPTION OF THE DRAWINGS

In the detailed description of the preferred embodiment of the invention presented below, reference is made to the accompanying drawings, in which.

DESCRIPTION OF THE PREFERRED EMBODIMENT

Figure 1:
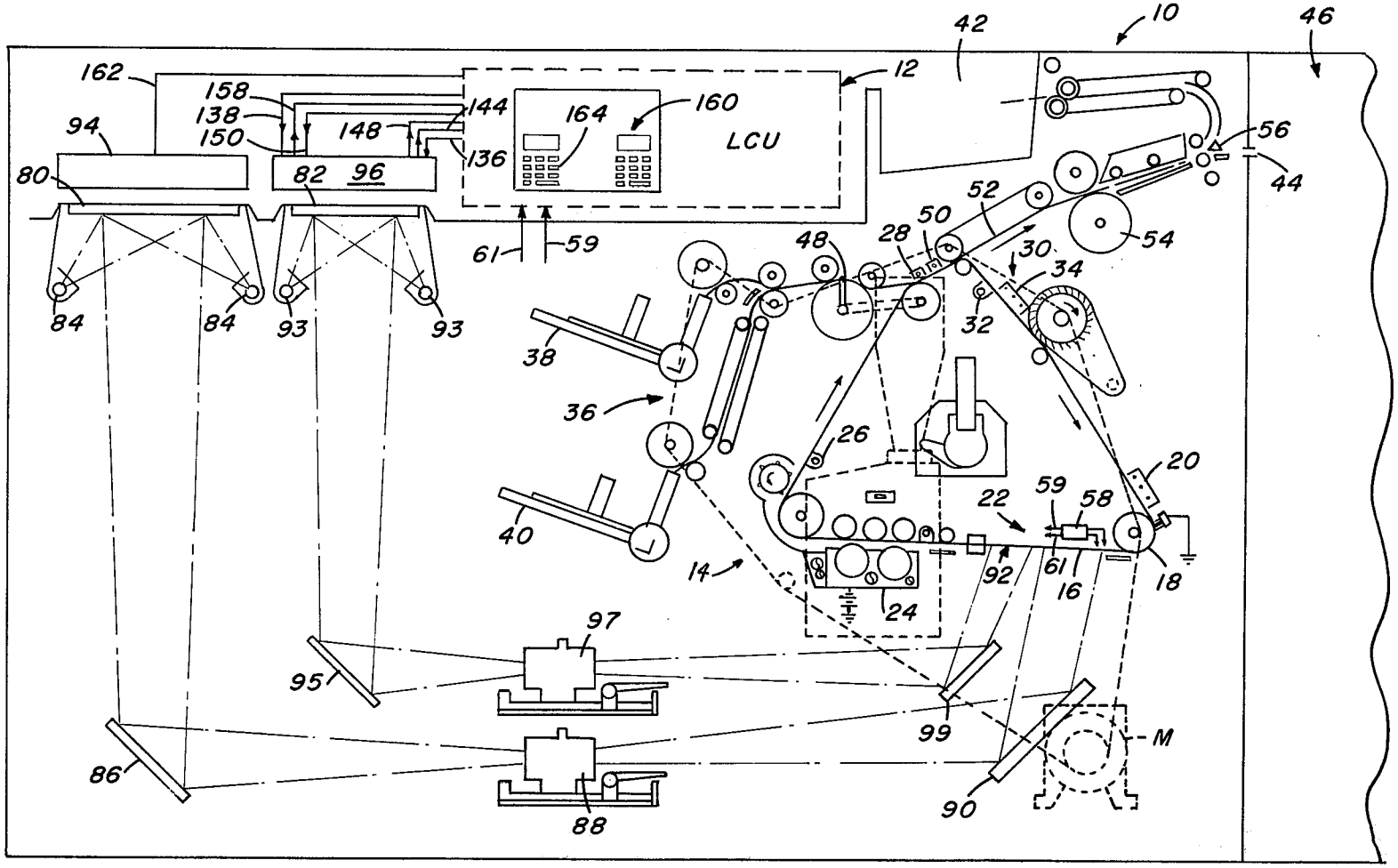
FIG. 1 is a schematic representation of a preferred embodiment of a copier apparatus of this invention.

Referring now to the drawings, a copier of the present invention is illustrated generally at 10 in FIG. 1. The copier includes a logic and control unit (LCU) 12 which monitors and controls various elements of the copier as described in more detail later. The copier includes a process section 14 having a photoconductor 16 trained to run in a closed-loop path about a plurality of web-constraining rollers. One of these rollers 18 is coupled to a drive motor M so that the photoconductor is driven in a clockwise direction in its closed loop path when the motor is connected to an appropriate source of potential. This movement of the photoconductor causes successive image frames on the photoconductor sequentially to pass adjacent a series of electrophotographic work stations which, for the purpose of this disclosure, can be described as follows:

- a charging station 20 at which the photoconductor is sensitized by receiving a uniform electrostatic charge;
- an exposing station 22 at which the photoconductor receives a latent electrostatic image by projecting a light pattern representing the document sheet onto the sensitized photoconductor;

a developing station 24 at which the latent electrostatic image is rendered visible by the application of toner;

a post development erase station 26 at which the photoconductor is illuminated to remove the residual charge on the photoconductor;

a transfer station 28 at which the developed and visible image is electrostatically transferred from the photoconductor to a copy support as will become more apparent hereinafter; and a cleaning station 30, including erase and discharging devices 32 and 34, respectively, at which the photoconductor is cleaned of any residual marking particles or electrostatic charge.

A copy handling mechanism 36 moves copy supports, such as paper, in a path from either of two supply hoppers 38 and 40, through the transfer station 28, and on to either a delivery hopper 42, where the copies are deposited for retrieval by the operator, or an exit 44, where the copies can be delivered to a finisher 46 for suitable finishing operations, such as jogging, stapling and stacking. Additional stations located along this path of movement include the following:

a registration device 48 for establishing proper alignment between the copy supports in the copy handling mechanism and the image frame of the photoconductor;

a discharging device 50 for reducing electrostatic attraction between the copy supports and the photoconductor in order to facilitate separation of the copy supports from the photoconductor;

a suitable transport 52 for the copy supports; a fusing device 54 for permanently fixing the toner to the copy support by the application of heat and pressure; and a sheet diverter 56 for directing the copy supports to either the delivery hopper 42 or exit 44.

The logic and control unit 12 coordinates operation of the various copier stations with movement of the copy supports and the latent and visible images on the photoconductor. To facilitate this coordination, the photoconductor is provided with a plurality of perforations, not shown, adjacent one of its edges: Means 58 adjacent the photoconductor sense the perforations. As explained in more detail later, sensing means 58 preferably senses two sets of perforations designated C and F perforations. Signals from the sensing means are furnishes to the logic and control unit 12 by leads 59 and 61. Additional sensors are provided in the copy path. In this manner input signals can be generated to which the LCU can respond for sequentially operating the work stations as well as for controlling the operation of many other machine functions. A more complete description of suitable means for coordinating operations in a copier is disclosed in U.S. Pat. No. 3,914,047, entitled SYNCHRONIZING CONTROL APPARATUS FOR ELECTROPHOTOGRAPHIC APPARATUS UTILIZING DIGITAL COMPUTER and issued in the names of William E. Hunt, Jr., et al. on Oct. 21, 1975.

Figure 3:
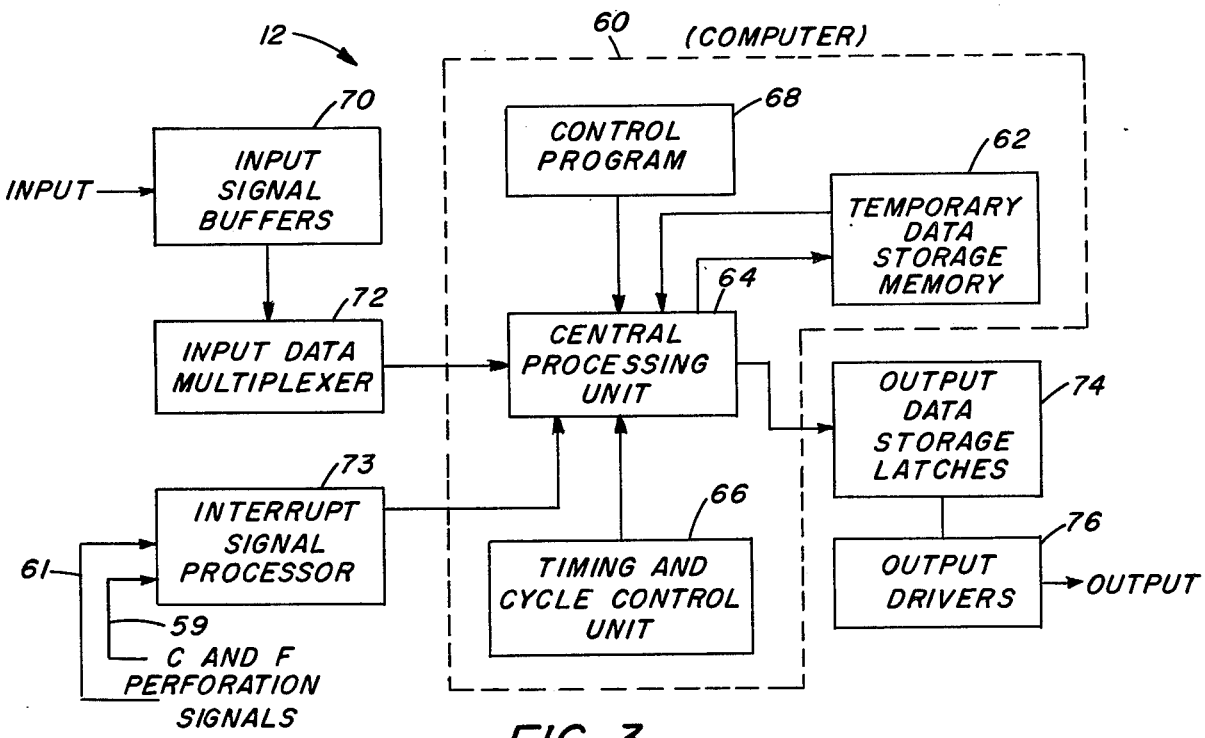
FIG. 3 is a block diagram of a logic and control unit for the copier shown in FIG. 1.

The logic and control unit 12 could be implemented by numerous suitable mechanisms such as relays, transistors, or small and medium scale digital integrated circuits. In this particular embodiment, a microcomputer 60 is utilized. FIG. 3 shows a block diagram of a typical logic and control unit (LCU) 12 which interfaces with the copier 10 and related apparatus. The LCU 12 consists of temporary data storage memory 62, central processing unit 64, timing and cycle control unit 66, and stored program control 68. Data input and output is performed sequentially under program control. Input data is applied to the central processing unit through input signal buffers 70 and a multiplexer 72. The input signals to the signal buffers 70 consist of logic level digital signals which are derived from various switches, sensors, and analog-to-digital converters. Input data also is applied from perforation sensor 58 and leads 59, 61 to an interrupt signal processor 73 and then to the central processing unit 64.

The output data and control signals are applied to storage latches 74 which provide inputs to suitable output drivers 76 directly coupled to leads which, in turn, are connected to the work stations. More specifically, the output signals from the LCU 12 are logic level digital signals which are buffered and amplified to provide drive signals to various clutches, brakes, solenoids, power switches, and numeric displays in the various copier work stations and the feeder.

The LCU processing functions can be programmed by changing the instructions stored in the computer memory. This programming technique provides a flexible machine logic and timing arrangement and extends the LCU capability to include the capacity for performing error diagnostics. For example, if an input signal is not delivered to the LCU at the appropriate time, the LCU can display an ERROR code on a control panel or shut down the machine operation. The ERROR code indicates a machine failure. During a copy cycle, the LCU executes the stored program which controls the processing of signal inputs to the LCU and initiates turn ON, turn OFF, and timing of output control signals.

The time sequence of machine control signals (often referred to in the art as events) is critical to the copy cycle becase the copier and feeder stations and associated mechanisms must be powered ON and OFF in the correct sequence to assure high quality copying and to prevent paper misfeeds, misregistration, and erratic operation. The primary purpose for controlling the time seqence of events and their relationship to each other is, as noted above, to sense perforations which correspond to the location of the image frames on the photoconductor as these elements continue through the cycle in an endless path. For example, the photoconductor may be divided into six image areas by one set of perforations (F perforations); and each image area may be subdivided by another set of perforations (C perforations). These F and C perforations (not shown) are described in more detail in the above-mentioned U.S. Pat. No. 3,914,047. As previously mentioned, these sets of perforations are detected by sensing means 58, and related signals are furnished to the LCU 12 by leads 59 and 61.

Returning now to the computer, the program 68 may be embodied by a Read Only Memory (ROM). The ROM contains the operational program in the form of instructions and fixed binary numbers corresponding to numeric constants. These programs are permanently stored in the ROM and cannot be altered by the computer operation. Typically, the ROM is programmed at the manufacturer's facility, and the instructions programmed provide the required control functions such as: sequential control, jam recovery, operator observable logic, machine timing, and automatic document rearrangement.

The temporary storage memory 62 may be conveniently provided by a conventional Read/Write Memory. Data such as: copy requested count, copies processed count, and copies delivered count, are stored in the RAM until successful completion of a copy cycle. The RAM is also used to store data being operated on by the computer and to store the results of computer calculations.

In accordance with the present invention two platens 80 and 82 are provided against which documents can be positioned for copying. A document on platen 80 is illuminated by flash lamps 84 and an image of the document is reflected by a mirror 86 to a lens 88, projected by the lens to a second mirror 90 and reflected to one portion of an image plane 92 formed along a flat portion of the photoconductor 16 in the area of the exposing station 22. Similarly, a document positioned on platen 82 is illuminated by flash lamps 93 and an image of the document is reflected by a mirror 95 to a lens 97, projected by the lens to a second mirror 99 and reflected onto a second portion of the image plane 92. While the drawings illustrate separate lenses and sets of mirrors for projecting images of the document onto adjacent portions of the photoconductor, it will be understood that a single set of mirrors and lenses can be provided and made adjustable between two positions so that an image from either platen could be projected onto the photoconductor in the image plane thereof.

While platens 80 and 82 could be of the same size and used for the same purpose, i.e., for making the same size copies by manual feeding of originals or by automatic document feeders, the provision of two different platens provides the opportunity for enhancing the versatility and productivity of a copier/duplicator. For example, platen 80 preferably is of a large size (e.g., 11"×17") to accept over-size or relatively large original documents, and lens 88 can be of the variable reduction type for making copies smaller than the original document. In addition, the platen 80 can be used for copying originals made by pasting onto a backing sheet, or otherwise assembling, copy from several different documents, it generally being preferred not to circulate such original documents through a recirculating feeder. However, a suitable document feeder, such as diagrammatically shown at 94, can be used for feeding over-size documents to platen 80 or for handling original documents that otherwise are not generally used in recirculating feeders. On the other hand, platen 82 can be smaller than platen 80 and a recirculating feeder 96 preferably is removably positioned over the platen 82 and is adapted to recirculate original documents to the platen for sequential exposure in an order which produces collated copies. Thus one or more pages of an original document that cannot be fed through the recirculating feeder 96 can be placed on platen 80 for making "master" copy of such originals, and the masters then can be fed through the recirculating feeder, thereby increasing the productivity of collated sets of copies from the machine.

Figure 2:
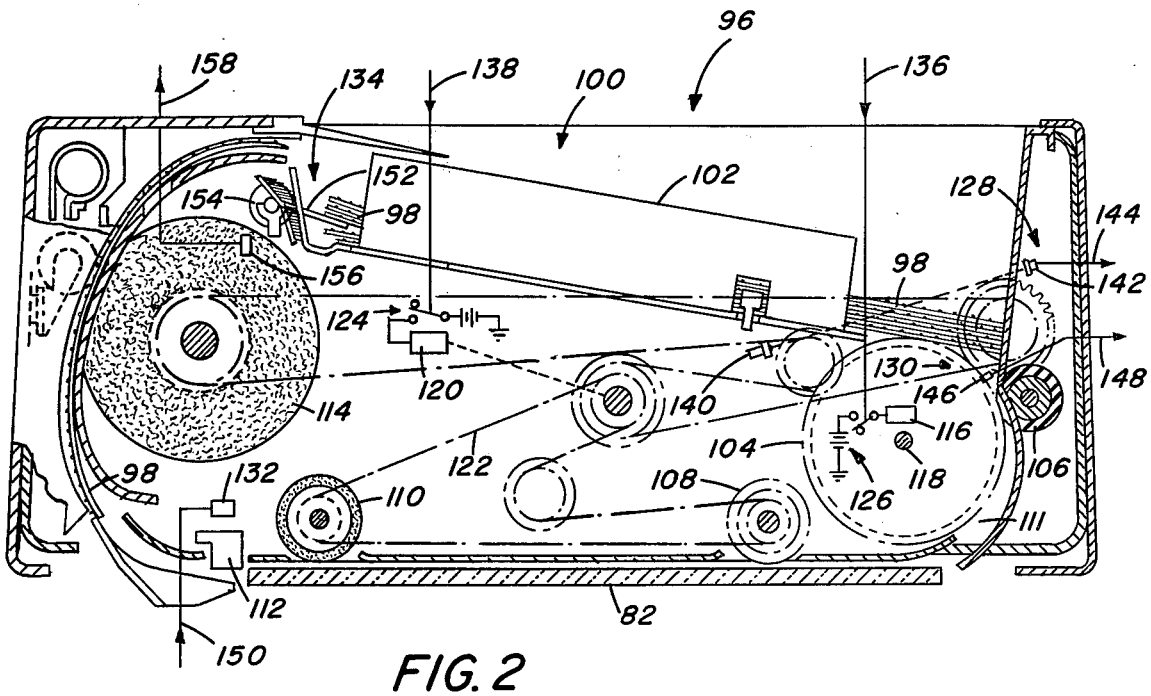
FIG. 2 is a cross-sectional view of a recirculating feeder for feeding documents to one of the platens.

A recirculating document feeder suitable for use with the present invention is disclosed in the beforementioned copending related U.S. patent application Ser. No. 647,683 and in the cross-sectional view of such a feeder illustrated in FIG. 2 of the drawings. In such a feeder, a set of original document sheets 98 are cycled seriatim from a storage section 100, including a stationary supply hopper 102, through an exposure position on the platen 82 and spaced from the storage section, and then back to the storage section 100. The document sheets are removed one-after-another in order from the bottom of the set, and returned each on top of previously returned sheets to maintain their beginning order. The entire set is presented for copying once, once again, and again and again to produce multiple sets of copies, with the number of presentations equalling the desired number of sets of copies.

A rotatably supported vacuum pick-off cylinder 104 oscillates for removing the sheets one-after-another from the hopper. The cylinder includes a series of air intake ports and relies on a vacuum for drawing air across the leading edges of the sheets to peel away the leading edge of the bottom-most sheet and adhere it to the cylinder. The cylinder then rotates clockwise (as viewed in FIG. 2) to draw the bottom sheet out of the set and deliver it downstream where its movement is continued by other feeding devices, 106, 108 and 110. Then the vacuum cylinder returns to its initial position so that it can pick-off the next sheet.

Feeding device 106 grasps the sheet and moves it through an arcuate channel 111 leading to the platen 82. Feeding devices 108 and 110 then take over to push the sheet into a registered position on the platen against a gate or pad 112. At this point further movement of the sheet is arrested temporarily and the lamps 93 are flashed for copying the document. After the sheet is copied once, the registration gate is withdrawn and the sheet is returned to the top of storage section 100 by previously mentioned devices 108 and 110, and by a suitable additional sheet driver 114.

The pick-off device is oscillated by a motor and clutch 116 acting through shaft 118. The various sheet driving and feeding devices, on the other hand, are driven by motor and clutch 120 acting through belt 122. In accordance with the preferred embodiment, the driving and feeding devices 106, 108, 110 and 114 operate continuously, although the rollers 108 and 110 may slip in engagement with the document sheets when the sheets momentarily are arrested on the platen for exposure. Such continuous operation reduces the mass that must be accelerated whenever movement of the original sheet is interrupted for exposure.

The feeder preferably is capable of presenting original sheets at a rate faster than the copier can make the exposures. It is not necessary, therefore, to drive the copier functions in response to feeder timing. Instead, it is the feeder that is responsive to copier timing. After one exposure the next successive original sheet is removed from hopper 102 and delivered to platen 82, in registration against pad 112, before the copier has recycled for the next exposure. Then, when the copy cycle is completed, the exposure occurs, pad 112 is removed, and a new sheet is delivered and is available for immediate exposure. Further details of the feeder 96 are set forth in U.S. application Ser. No. 647,683 which is incorporated into the present application by reference.

The feeder has first and second actuating switches 124 and 126, two sheet sensing switches 128 and 130, a solenoid and switch 132, and a set-completed detector 134. The first and second actuating switches operate independently of each other in response to control signals received from the CPU via leads 136 and 138 for selectively coupling the respective motors 111 and 120 to suitable sources of potential, thus causing the motors to operate as desired.

Sheet or document sensor 128 includes a light emitting diode (LED) 140 and a photocell 142. The LED and photocell are positioned adjacent to hopper 102 and the photocell receives light energy from the diode only when the supply hopper 102 is empty. When one or more document sheets are in the hopper, on the other hand, the light energy emitted by the LED is blocked by the sheets, and this information is transmitted to the CPU via lead 144.

Sheet sensor 130 includes a microswitch 146 adjacent feeding roller 106. Whenever a document sheet passes this switch the switch closes and sends a signal representing a logic "1" to LCU 12 via lead 148. Otherwise, i.e., when there is no sheet adjacent the switch, the signal represents a logic "0." The solenoid and switch 132 is actuated through lead 150 and operates to remove and reposition the pad 112 in response to a signal from CPU 12.

Set-completed detector 134 includes a separator member 152 which extends into the supply hopper 102 for separating the document sheets into those which have been exposed and those which remain to be exposed. The separator member is fixed to a rotatably support shaft of a tendency drive motor 154. As the sheets are fed in succession from the set to the exposure platen and returned singly to the top of the set, the separator member rotates incrementally in a clockwise direction until the last sheet is removed. It then drops through an opening in the hopper and rotates under the influence of the tendency drive until it is shut-off or returns to its position on top of the original set. During this rotation, the separator member actuates a micro switch 156 which provides a pulse through lead line 158 for indicating to the CPU that a set of original sheets has been copied once. The computer 60 counts and totalizes the number of copy sets which have been made. At the end of the copy job, the computer recognizes concurrence between the number of switch actuations and the number of sets of copies requested and, after the last sheet to be exposed is returned, the feeder 96 is deactivated. The number of sets or copies to be made from a document in feeder 12 is furnished to the computer by means of a keyboard 160 (FIG. 1).

The document positioner or feeder 94 positioned over platen 80 is also functionally coupled to LCU 12 by means shown diagrammatically at 162 in FIG. 1. Coupling 162 represents those connections between the positioner 94 and the LCU 12 that are necessary for the positioner to be controlled by the LCU. For a document positioner as shown at 94, coupling 162 can be much less complex than the connections for recirculating feeder 96 because fewer functions may need to be sensed by the LCU and controlled by it. Since document feeders or positioners are generally well known in the art, a detailed description of the feeder 94 and coupling 162 is not set forth in detail herein. In this regard, reference is made to U.S. Pat. No. 4,078,787 which issued on Mar. 14, 1978 in the names of L. E. Burlew, et al.

The number of copies or sets of copies to be made from documents fed to the platen 80 is furnished to the computer 60 by means of a keyboard designated 164 in FIG. 1. The LCU advances an increment sheet counter when a copy is to be made from platen 80, exposes the document on the platen 80 by flashing lamps 84 at the appropriate time in the machine cycle, and then compares the sheet counter and the number of copies requested. When the sheet counter and the number of copies requested are identical, the LCU commands the device 94 to feed the original document from the platen 80. Then the next document is advanced to the platen. When documents are to be manually fed to platen 80, positioner 94 and coupling 162 are omitted, and the LCU controls the sheet counter and copier apparatus to make the number of copies requested from keyboard 164.

As mentioned previously, it may be desireable to use platen 80 to prepare masters which can be fed through the recirculating feeder. In order to fully utilize the high speed capabilities of modern copiers, and especially those copiers with a recirculating feeder, the apparatus of this invention preferably is controlled so that the copying sequence for making copies by using the recirculating feeder 96 can be interrupted temporarily to make one or more copies (masters) from platen 80, and then the copy sequence using feeder 96 is automatically continued after the copies have been made from platen 80. Thus, a first job being run on the recirculating feeder can be interrupted temporarily while masters for a second job are prepared from platen 80. Then the second job using feeder 96 can be started immediately after the first job is completed. In this way the productivity of the copier can be increased. This also permits short jobs to be run from platen 80 without waiting for a relatively long job to be completed from platen 82.

Figure 4:
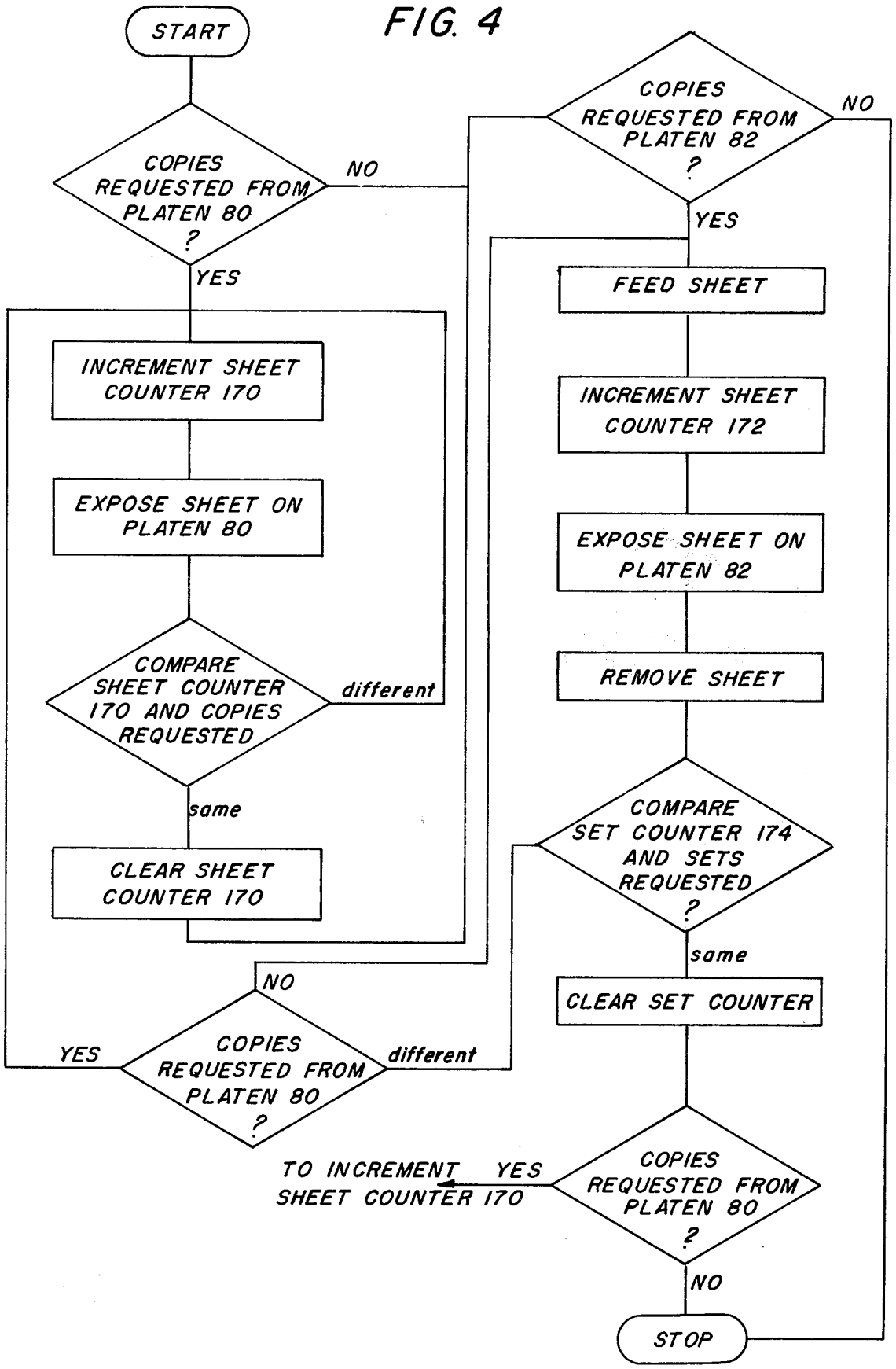
FIG. 4 is a flow chart presenting a logical sequence of operation for the copier of the present invention.

FIG. 4 shows a flow chart which represents a logical operation of the copier of this invention to provide for preference for making copies of documents on platen 80 even if it requires interrupting of the normal operation of a job being run from feeder 96. After the copier is started the LCU will determine if an operator has requested copies from platen 80 by inputting data through keyboard 164. Assuming initially that copies have been requested from platen 80, the LCU will, if appropriate, operate the document positioner 94 by means of the connection 162 and, when the document is properly positioned on platen 80, the LCU will then increment a sheet counter 170 which functions to keep track of the number of times a document sheet on platen 80 is copied. Then, at the appropriate time as determined by signals received from the sensor 58 that senses the perforations in photoconductor 16, the lamps 84 are flashed to expose the original document on platen 80 and project an image of the document onto the photoconductor. As a result, an image is formed on photoconductor 16, and this image is processed and transferred to a copy sheet, and then fused to the sheet in the manner explained hereinbefore. Preferably, the LCU positions sheet diverter 56 to deflect into hopper 42 copies of documents made from platen 80.

Next the LCU compares the sheet counter 170 and the number of copies requested by the operator through keyboard 164. Assuming initially that the requested number of copies has not been made, the cycle is again repeated by incrementing the sheet counter 170, exposing the sheet on the platen 80 and again comparing the sheet counter 170 with the number of copies requested. When the sheet counter and the number of copies requested from platen 80 are in agreement, then the sheet counter 170 is cleared.

When the required number of copies have been made from platen 80, or if no copies have been requested from platen 80 at the time the copier is started, then the LCU determines if copies have been requested from platen 82 by inputting data into keyboard 160. If copies have not been requested from platen 82, then the machine cycle is stopped. If copies have been requested from platen 82, then the LCU will determine if one or more document sheets are positioned in the recirculating feeder supply hopper 102 by sampling the lead 144 connected to the photo cell 142. Upon finding the appropriate signal for "original present," the LCU will send a pulse through line 138, thereby closing switch 124 and energizing both the motor 102 and the vacuum source for the pick-off device. Next the LCU will energize the tendency drive for the set-completed detector 134 so that its separating member 152 will rotate to the position overlying the top sheet of the original document. Then the LCU sends appropriate pulses through leads 150 and 136, respectively, to drop registration gate or pad 112 and to initiate oscillation of the pick off cylinder 104. This brings about the removal of the bottom-most sheet from the document set in hopper 102, and its presentation onto the platen 82 and against registration gate or pad 112 in position for copying. Through lead 148 the LCU will determine when a document sheet has passed the switch 130 and, at that time, the LCU will increment a sheet counter 172.

Using signals from sensor 58 again, the LCU determines the appropriate time for actuating the flash lamps 93 to effect copying of the original document presented at platen 82. The image is projected onto the photoconductor, developed, transferred to a copy sheet, and fused to that sheet in the manner explained hereinbefore. For documents made from platen 82, the LCU preferably operates sheet diverter 56 to furnish such copy to the finisher 46. However, it will be understood that copies from either platen can be furnished to either the finisher or to the hopper 42, and the operator can instruct the LCU to furnish copies to the finisher or to hopper 42 by providing suitable input through the keyboards of the copier.

After the document on platen 82 has been exposed, the LCU pulses line 150 to effect removal of the registration pad 112 and the document is then driven from the platen and back onto the top of the stack of document sheets in the supply hopper 102. The LCU then interrogates line 158. Assuming that the separator member 152 is blocked by other sheets of the original document that have not yet been copied, the LCU will determine by comparison of a set counter 174 and the number of sets of copies requested from platen 82 that additional copies are required. However, before proceeding with copying of additional documents on platen 82, the LCU again will determine if copies have been requested from platen 80. If such copies had been requested then the LCU will return to copying from platen 80 by incrementing the sheet counter 170, exposing the sheet on the platen, etc., in the manner previously described. When the sheet counter 170 coincides with the number of copies requested from platen 80, the LCU will again return to the incompleted job on platen 82. Then another sheet from the recirculating feeder will be fed, counted, exposed and removed as previously described. This operation continues until such time as the required number of sets of copies have been completed and as indicated by a comparison of the set counter 174 and the number of sets requested. At this time the set counter will be cleared. The LCU will once more determine if additional copies have been requested from platen 80. If the answer is yes, then the cycle for copying a document on platen 80 will be repeated again. If the answer is no, then the machine will be stopped by the LCU.

In the process of making copies at platen 82 by use of the recirculating feeder 96, it is preferred that the LCU keep track of the number of documents fed from the hopper 102 each time a set is made and compared to the adjacent sets being made. In other words, the LCU will count (by counter 172) the number of documents in the first set by receiving a signal from switch 130 via lead 148 each time a document sheet is fed to the platen between activations of set switch 156. That information will be stored temporarily in the LCU until such time as the second set is made. When the second set is completed, as indicated by the actuation of switch 156, the number of documents circulated during the making of the second set of copies will be compared to the number of documents circulated during the making of the first set of copies. If the numbers are different, it will indicate that multiple feed of document sheets has occurred when one or the other of the sets was copied, and the LCU will shut down the recirculating feeder and provide a suitable signal advising the operator of this inconsistency. In the event the number of documents circulated in each sets coincide, the LCU will continue the copying program, again monitoring the number of documents circulated in each set and comparing them with the preceeding and succeeding sets. If double-sheet feed detection is not required, then the sheet counter 172 and switch 146 may be omitted. The double-sheet feed projection mode of operation is described more fully in commonly assigned U.S. Pat. No. 4,076,408, entitled COLLATING DOCUMENT FEEDER WITH MULTIPLE FEED DETECTOR, issued in the names of M. G. Reid, L. E. Burlew and D. C. Hogan on Feb. 28, 1978.

As will be apparent from the foregoing description, the LCU continues to monitor the position of the photoconductor 16 and various other operations in the copier/duplicator of the invention and thereby can sequence the operation of the exposure means 84 and 93 so that the images projected onto the photoconductor do not overlap. More specifically, as illustrated in the drawings, an image projected on the photoconductor from platen 80 will need to advance a finite distance along the path of travel of the photoconductor and pass the area where the image is received from platen 82 before the lamps 93 can be actuated to project onto the photoconductor an image of the document on platen 82. In addition, it will be apparent that the LCU operates the exposure means for each of the platens in a programmed order which provides for preference for exposure of documents positioned on platen 80.

In the event it is desired to provide a recirculating feeder positioned over platen 80 as well as over platen 82, then the mode of operation illustrated in FIG. 4 can be modified so that the same sequence of operations illustrated for copying of documents at platen 82 is used for operation of the feeder over platen 80. There are various occasions when a recirculating feeder might be desired for both platens. For example, if the copier is to be used for running both relatively long jobs and relatively short jobs, the relatively long jobs could be operated from platen 82 and interrupted for relatively short jobs from platen 80, thus giving preference to the short jobs. This will permit the operator to complete the short jobs without manually interrupting the longer jobs and will permit the machine to automatically return immediately to completion of the longer jobs as soon as the short job is completed. Similarly, jobs of highest priority could be run from platen 80 and routine jobs could be run from platen 82.

The invention has been described in detail with particular reference to a preferred embodiment thereof, however it will be understood that variations and modifications can be effected within the spirit and scope of the invention as described herein above and as described in the appended claims.

I claim:

1. Document copying apparatus comprising: a first platen for receiving a document to be copied, a second platen spaced from the first platen for receiving another document to be copied, means operable when actuated for making copies of documents received on the respective platens, and control means responsive to the presence of a document on the second platen for actuating said making means to make a copy of the document on the second platen prior to making a copy of the document on the first platen.

2. The invention of claim 1 wherein said making means comprises a moving imaging member for forming images of the document in non-overlapping relation thereon, and wherein said control means comprises means responsive to the movement of said member for actuating said making means only when the member is positioned to form a document image which does not overlap a previously formed document image on the member.

3. In a copier having an electrostatically charged moving photoconductive member for receiving light images of documents to form latent electrostatic images corresponding to the light images;

first and second exposure platens for receiving documents to be copied;

first means for illuminating a document at the first exposure platen;

second means for illuminating a document at the second exposure platen;

projection means for projecting onto the photoconductive member a light image of an illuminated document at either the first exposure platen or the second exposure platen; and control means for selectively operating the first and second illuminating means so that the projected light images do not overlap on the photoconductive member.

4. In a copier having a photoconductor adapted to receive an image of a document to be copied and to copy the image onto a copy sheet or the like, the improvement comprising:

first and second exposure stations for receiving documents to be copied;

first exposure means for illuminating a document at the first exposure station;

second exposure means for illuminating a document at the second exposure station;

projection means for projecting onto the photoconductor an image of an exposed document at either the first exposure station or the second exposure station; and control means for operating the first and second exposure means so that images projected onto the photoconductor by the projection means do not overlap.

5. The invention as set forth in claim 4 further comprising means mounting the photoconductor for movement, and wherein the control means comprises a central processing unit coupled to the photoconductor and the first and second exposure means for controlling the sequence of operation of the first and second exposure means and movement of the photoconductor.

6. The invention as set forth in claim 4 wherein the control means comprises a programmed logic and control unit for receiving input signals indicative of the number of copies to be made of a document at the first exposure station and the number of copies to be made of a document at the second exposure station, and the logic and control unit including means for operating said first and second exposure means in a programmed order providing preference for exposure of a document at one of said exposure stations.

7. In a copier having a photoconductor adapted to receive an image of a document and to copy the image onto a copy sheet or the like, the improvement comprising:

a first platen and a second platen, each of said platens being adapted to receive a document to be copied;

means for forming on the photoconductor, an image of a document at the first platen or an image of a document at the second platen; and control means for controlling the order in which images of documents at the first and second platens are formed on the photoconductor so that a document at the first platen is copied before a document at the second platen.

8. The invention as set forth in claim 7 wherein the control means comprises a programmed logic and control unit for receiving input signals indicative of the number of copies to be made from a document at the first platen and the number of copies to be made from a document at the second platen, and the control means further includes means for interrupting the copying of a document at the second platen to copy a document at the first platen and then return to copying the document at the second platen.

9. The invention as set forth in claim 7 further comprising first and second copy receiving means for receiving copy sheets, diverter means operated by said control means for directing copy sheets to the first copy receiving means or the second copy receiving means, and said control means being effective to direct copies of the document at the first platen to one of the copy receiving means and to direct copies of the document at the second platen to the other of the copy receiving means.

* * * * *